United States Patent [19]

DeLong et al.

[11] 4,366,739

[45] Jan. 4, 1983

[54] PEDALBOARD ENCODED NOTE PATTERN GENERATION SYSTEM

[75] Inventors: Charles E. DeLong, Dubois; John W. Robinson, Jasper, both of Ind.

[73] Assignee: Kimball International, Inc., Jasper, Ind.

[21] Appl. No.: 151,933

[22] Filed: May 21, 1980

[51] Int. Cl.[3] ..... G10F 1/00

[52] U.S. Cl. ..... 84/1.03; 84/1.17; 84/1.24; 84/DIG. 12; 84/DIG. 22

[58] Field of Search ..... 84/1.03, DIG. 12, DIG. 22, 84/1.01, 1.17, 1.24

[56] References Cited

U.S. PATENT DOCUMENTS

| | | | |
|---|---|---|---|
| Re. 29,144 | 3/1977 | Bunger | 84/1.03 X |
| 3,422,210 | 1/1969 | Enya | 84/1.24 |
| 3,610,805 | 10/1969 | Watson | 84/1.13 |
| 3,629,481 | 12/1971 | Bunger | 84/1.03 |
| 3,665,090 | 5/1972 | Wangard et al. | 84/1.03 |
| 3,715,442 | 2/1973 | Freeman | 84/1.01 |
| 3,740,449 | 6/1973 | Southard | 84/1.01 |
| 3,955,460 | 5/1976 | Southard | 84/1.17 |
| 4,072,078 | 2/1978 | Shallenberger et al. | 84/1.03 |
| 4,152,965 | 5/1979 | Howell | 84/1.03 |
| 4,192,212 | 3/1980 | Yamaga et al. | 84/DIG. 22 |
| 4,315,451 | 2/1982 | Uchiyama et al. | 84/1.03 |
| 4,327,622 | 5/1982 | Aoki | 84/1.03 |

*Primary Examiner*—J. V. Truhe
*Assistant Examiner*—Forester W. Isen
*Attorney, Agent, or Firm*—Albert L. Jeffers; John F. Hoffman

[57] ABSTRACT

A system for use in electronic organs and electronically actuated organs wherein a pattern of notes sounding as if played on the accompaniment or solo manual are played from the pedalboard. The pedalboard is encoded such that depression of a pedal will generate an encoded binary word corresponding to a chord having as its root the note corresponding to the depressed pedal. Individual notes of the chord are played in a rhythmic sequence at a rate determined by the rhythm generator of the organ and in a pattern which can be selected by the organist. As the pattern is being automatically played, the organist is free to manually play a melody on the solo manual and accompaniment chords on the accompaniment manual. The pattern is changed from a major key to a minor key having the same root note by actuating a knee paddle.

7 Claims, 5 Drawing Figures

PEDALBOARD ENCODED NOTE PATTERN GENERATION SYSTEM

BACKGROUND OF THE INVENTION

The present invention relates to electronic organs, and in particular to a system for automatically generating a pattern of notes for accompanying the music manually played by the organist.

Although an organ is basically a complex instrument and one which is difficult to play, the advent of modern electronics has enabled the incorporation of a number of easy play features, which simplify the playing of the organ and make it a more attractive instrument to a beginner. These easy play features simulate or duplicate the effects which could otherwise only be achieved by a much more experienced player, such as the playing of fill notes, arpeggios, and the like.

One of the basic features incorporated into most electronic organs for simplifying playing is that of the automatic chord generator wherein the depression of a single key automatically plays the appropriate notes of the chord either arbitrarily assigned to that key or having that key as its root tone. Another feature, which is commonly used in conjunction with the automatic chord feature, is the automatic note pattern generator wherein the organ automatically plays a rhythmic pattern of notes corresponding to the chord which is played. For example, if a C major chord has been selected, the note pattern may consist of the notes C, E, G played as an arpeggio or a melodic sequence. As the automatically generated note pattern is being played, the performer may continue to play a melody on the solo manual as long as the appropriate chord key is held on the accompaniment manual.

Although the ability to have a note pattern automatically played merely by depressing a single chord key is very attractive to the beginning organist because it enables him to concentrate on playing the melody on the solo manual, his playing skill will soon reach the level where he is no longer satisfied with being constrained to use the automatic chord feature. Because the number of chords which can be generated by the automatic chord feature is limited and there is generally no flexibility insofar as chord inversions are concerned, the progressing organist will at some time desire to abandon the use of the automatic chord feature and begin playing the chords manually. Once this is done, however, certain of the more important easy play features are lost, such as that of automatic note pattern generation. This represents a substantial increase in the difficulty in playing, because now the organist must not only be concerned with playing the melody on the solo manual and playing the chords manually on the accompaniment manual, but he must also manually play the arpeggios and other accompaniment note patterns. Thus, existing organs, although very suitable for beginning players, do not provide sufficient flexibility to enable the progressing player to gradually discontinue the use of easy play features as he achieves higher levels of skill.

SUMMARY OF THE INVENTION

The present invention enables the intermediate organist to manually play his own chords on the accompaniment manual, but still provides him with the option of having a number of note patterns, such as arpeggios and other melodic passages, automatically played by the organ. The present invention takes advantage of the fact that, when an intermediate organist plays a chord, he will generally play the pedal which corresponds to the root note of that chord. In other words, he will play a C pedal for a C chord, either major or minor, an A pedal for an A chord, and so forth. The system receives its command from the pedalboard, which generates a pair of binary words corresponding to the major and minor chords having as its root the note corresponding to the depressed pedal. In other words, if the C natural pedal is depressed, a five bit binary C major chord word will be generated together with a five bit binary C minor chord word. A player actuated switch selects either the major chord word or the minor chord word, and the selected chord word will be transmitted to the chord data input of the note pattern generator.

The note pattern generator may be of conventional design, such as that described in U.S. Pat. No. 4,120,225 owned by the assignee of the present application. Alternatively, the note pattern generation system could be that disclosed in allowed copending application Ser. No. 932,226 filed Aug. 9, 1978 now U.S. Pat. No. 4,220,068, and also owned by the assignee of the present application. These note pattern generation systems decode the chord word and generate the appropriate pattern based on a pattern selected from a plurality of patterns stored in a read only memory and at a rate which is determined by the organ rhythm unit. Thus, one of the advantages of the present invention, is the ease with which it can be incorporated into existing organ systems of the type wherein a chord word is utilized to determine the harmonic key of the pattern. U.S. Pat. Nos. 4,120,225 and 4,220,068 are expressly incorporated herein by reference.

Specifically, the present invention contemplates an electronic organ comprising a keyboard including a plurality of keys corresponding respectively to notes of the musical scale and adapted to be played by the player's hands, a pedalboard including a plurality of pedals corresponding respectively to notes of the musical scale and adapted to be played by the player's feet, and tone producing means for generating selected tones. The tone producing means generally comprises that portion of the organ output circuitry including the tone generator, keyers, voicing circuits, amplifier and speaker. Keyboard controlled means connected between the keyboard and a plurality of the tone producing means control inputs causes the tone producing means to generate tones corresponding to depressed keys of the keyboard and within a first frequency range, and pedalboard controlled means connected between the pedalboard and a plurality of tone producing means control inputs causes the tone producing means to generate bass tones corresponding to depressed pedals of the pedalboard and within a second frequency range, which is generally lower than the first frequency range. A selectively operable note pattern generator means is connected between the pedalboard and the tone producing means and is responsive to the depression of any one of the pedals for causing the tone producing means to generate a sequence of diverse tones in a rhythmic note pattern wherein the diverse tones are notes of a chord harmonically compatible with the note to which the depressed pedal corresponds. The diverse notes are in said first frequency range and generally higher in frequency than the bass tones corresponding to the pedals of the pedalboard.

The keyboard controlled means and the pedalboard controlled means contemplate the entire spectrum of suitable circuitry for actuating a keyer in response to the depression of a key of the keyboard or pedal of the pedalboard. In a very basic system, for example, this may comprise a single wire extending from the keyswitch to the keyer control input. In a multiplexed organ, on the other hand, the keyboard and pedalboard may be multiplexed to form a serial data stream, which is subsequently demultiplexed to enable actuation of the appropriate keyers. If desired, the data stream could be utilized for developing fill note data and used in the generation of the note pattern by the automatic note pattern generation circuitry.

One of the significant advantages of the system according to the present invention is that the use of the automatic note pattern generation feature does not limit the ability of the organist to play manually on the solo and accompaniment manuals any chords or melody he desires. Furthermore, the bass tone can continue to sound as long as the bass pedal is depressed so that the normal operation of the pedalboard is not necessarily deactivated.

Although existing organs include bass pattern generation circuitry wherein the depression of a pedal will cause the organ to automatically play a selected bass pattern, this pattern consists only of bass notes, which are much lower in frequency than the note pattern played by the present invention, which preferably sounds from the 8′ solo or accompaniment manual. The note pattern in question is generally several octaves higher than the bass pattern and is suitable for playing concurrently with the bass pattern. For example, if the present system is incorporated into an organ having both a solo or accompaniment manual note pattern generator as well as a bass note pattern generator, then both of these patterns can be play simultaneously with the melody and chords played by the organist on the solo and accompaniment manuals, respectively.

It is an object of the present invention to provide a note pattern generator which is activated from the pedalboard so that the organist may continue to play a melody and chords on the solo and accompaniment manuals, respectively.

It is a further object of the present invention to provide an easy play feature particularly adapted for the intermediate player who has progressed beyond the need for the automatic chord feature, but has not yet advanced sufficiently to play all of the accompaniment passages himself.

A still further object of the present invention is to provide a system wherein a note pattern can be played automatically and simultaneously with the playing of the proper bass note and manually selected notes and chords on the solo and accompaniment manuals.

These and other objects and features of the present invention will become apparent from the detailed description of the preferred embodiment considered together with the appropriate drawing figures.

and

FIGS. 2A through 2D together form a detailed circuit schematic of the pedalboard encoding system.

DESCRIPTION OF THE PREFERRED EMBODIMENT

Figure 1:
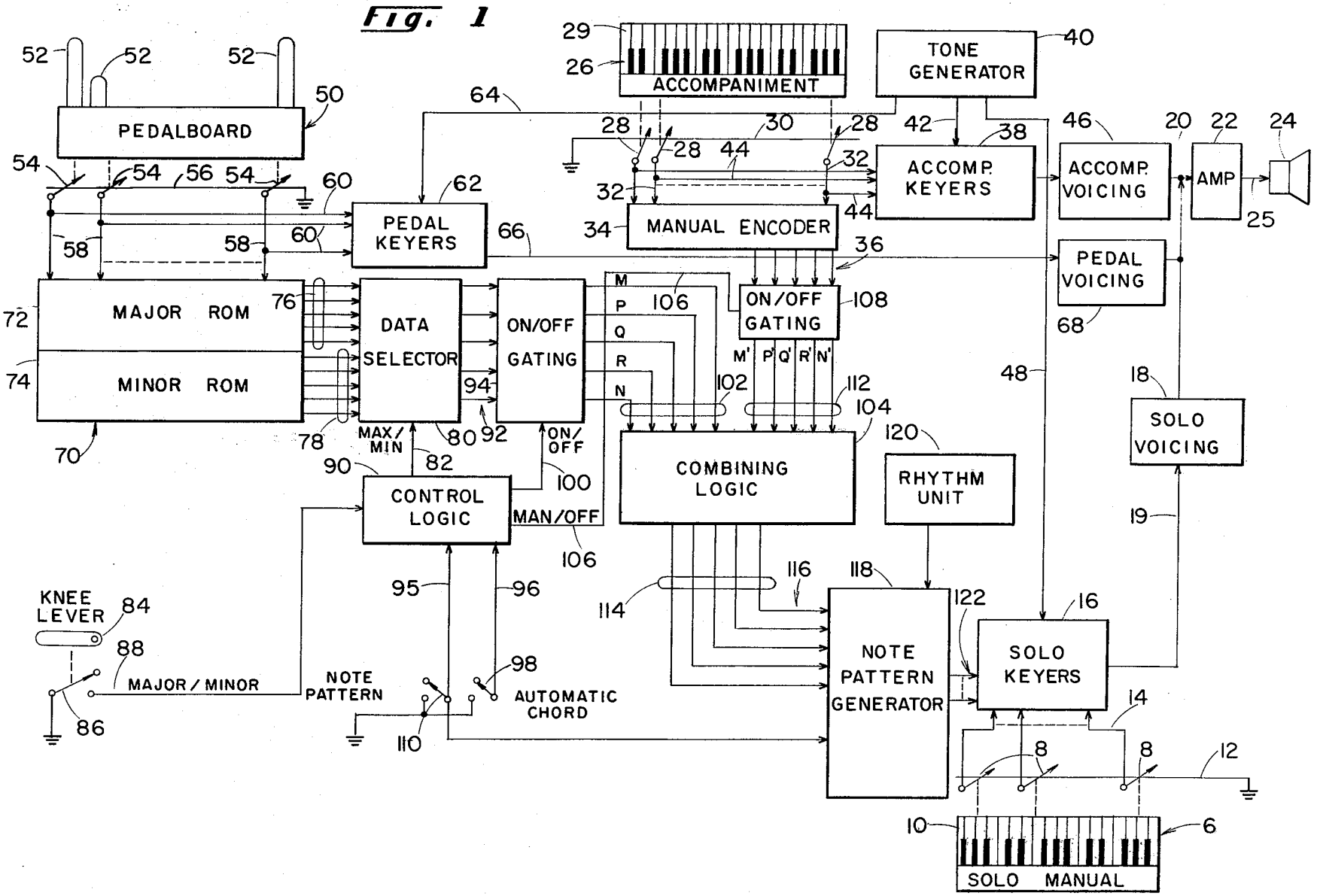
FIG. 1 is a block diagram of an electronic organ incorporating the pedal activated note pattern generator of the present invention.

Referring now to the drawings, and in particular to FIG. 1, solo manual 6, which may be the upper portion of a single manual electronic musical instrument or the forty-four note or sixty-one note manual of a spinet or console organ, includes a plurality of keyswitches 8. Keyswitches 8 are actuated by the keys 10 of manual 6 and are caused to come into contact with grounded rail 12 thereby placing a ground potential DC signal on inputs 14 to solo keyers 16. As discussed earlier, the direct connection between keyswitches 8 and solo keyer 16 is the most straightforward, and is merely for the purpose of illustrating the overall arrangement of the organ. Typically, however, keyswitches 8 would be multiplexed to form a serial data stream which would then be demultiplexed to actuate the respective keyers 16. The output of solo keyer 16 is fed to solo voicing circuit 18 over line 19, and the output of circuit 18 is connected to the input 20 of audio amplifier 22. The output of amplifier 22 is connected to speaker 24 over line 25 to produce the acoustic tones generated by the organ.

Accompaniment keyboard 26 may comprise the lowermost keys of the single manual spinet keyboard or the lower forty-four note manual or sixty-one note manual in a console or theater organ. Keyswitches 28 are actuated by the respective keys 29 of accompaniment manual 26 to make contact with grounded rail 30 thereby placing on input lines 32 a ground level DC potential. Inputs 32 are connected to accompaniment manual encoder 34, which, through matrixing, diode gating, or other appropriate means, encodes the depressed key 29 of the accompaniment manual as a five bit binary word on output lines 36. Encoder 34 is utilized for the automatic chord generation feature wherein all or a selected number of the accompaniment keys 29 correspond to respective chords, such as C major, A minor, C7, etc. Thus, by depressing one of the keys 29, a chord word on lines 36 will be generated, thereby eliminating the necessity for the organist to develop the chords manually on the accompaniment manual. Such manual encoders are well known in the prior art and may take the same basic form as the pedalboard encoder illustrated in FIGS. 2A and 2B of the present application. A further example of a manual encoder is disclosed in copending Application Ser. No. 904,741 filed May 11, 1978. Encoder 34 produces on outputs 36 a five bit binary word which is unique to the single depressed key of the accompaniment manual 29, and this word is associated with a particular chord, which may be musically related to the depressed key or arbitrarily assigned to that key.

The input lines 44 are connected to the inputs of accompaniment keyers 38, which is fed from tone generator 40 over lines 42 with the tones appropriate for this particular frequency range. Depending on which of accompaniment keyers 38 are actuated by signals on their input lines 44, the appropriate tone or tones from tone generator 40 will be keyed to accompaniment voicing circuit 46 and from there will be amplified by amplifier 22 and converted to acoustic sounds by speaker 24. Solo keyers 16 are also provided with tones on lines 48 from tone generator 40 wherein the tones are in the frequency range appropriate for the solo manual 6.

In a typical electronic musical instrument having a single manual keyboard, the solo manual 6 pertains to the upper portion of the keyboard and the accompaniment manual 26 to the lower portion thereof. In a smaller spinet organ, the solo manual 6 and accompaniment manual 26 each comprise forty-four keys which are offset relative to each other so that the center portions of each of the keyboards 6 and 26 will overlap, both physically and in frequency. In larger console organs having sixty-one note solo and accompaniment manuals, there will be complete overlapping between the manuals 6 and 26, both physically and in frequency, although the voicing for the respective manuals may differ.

The pedalboard 50 comprises a plurality of pedals 52, which are adapted to be actuated by the feet of the player, as opposed to the keys 10 and 29 of keyboards 6 and 26, which are adapted to be played by the fingers. The frequency range covered by the pedalboard 50 is generally lower than that of the solo manual 6 and accompaniment manual 26, and is generally limited to not more than thirty-two notes. Although the pedalboard 50 will overlap in frequency with the lower portion of the accompaniment manual and perhaps even the lower portion of the solo manual depending on the footages which are selected, the frequency range of pedalboard 50, when considered as a whole, is generally lower than the frequency ranges of the accompaniment manual 26 and solo manual 6. Typically, the pedalboard 50 plays bass tones at 16′ and 32′ whereas the accompaniment and solo manuals play most often in the 8′ and above ranges. Thus, there is a general division in frequency between the pedalboard 50 and the solo and accompaniment manuals wherein the frequency range of the pedalboard 50 is generally lower than the overall frequency range of the other two manuals 6 and 26.

Keyswitches 54 are actuated by respective pedals 52 of pedalboard 50 to come into contact with grounded rail 56 thereby placing on inputs 58 a ground level DC potential. Inputs 58 are also connected to the inputs 60 of pedal keyers 62, which are fed with the appropriate lower frequency tones from tone generator 40 over lines 64. The actuated pedal keyer 62 keys the appropriate tone from lines 64 onto line 66, which is voiced in pedal voicing circuit 68 and then amplified by amplifier 22. If desired, pedal keyer 62 may be made inoperable when pedalboard 50 is utilized to activate the note pattern in accordance with the present invention.

Inputs 58 are connected to read only memory 70, which comprises a major key chord ROM 72 and a minor key chord ROM 74. Major ROM 72 encodes the activated input 58 from pedalboard 50 to produce a five bit binary word on output lines 76 corresponding to the major key chord having as its root note the note corresponding to the depressed pedal 52 of pedalboard 50. For example, if an E natural pedal 52 is depressed, the five bit binary word on output lines 76 will correspond to the E major triad. Similarly, minor ROM 74 encodes the inputs 58 from pedalboard 50 to produce on output lines 78 a five bit binary word corresponding to the minor triad having as its root the note corresponding to the depressed pedal 52 of pedalboard 50. For example, if an E natural pedal is depressed, the five bit binary word on output lines 78 will correspond to the E minor triad.

The outputs 76 and 78 of ROM 70 are connected to the inputs of data selector 80 having a control input 82. A knee lever 84, which is typically located underneath the keyboard, is positioned to be actuated by the knee of the organist so as to close switch 86 thereby placing on line 88 a ground potential DC control signal. When knee lever 84 is unactuated so that switch 86 is open, a positive voltage (logic level 1) is present on line 88, and this is gated to data selector control input 82 by control logic 90. This causes data selector 80 to connect the major ROM output lines 76 to output lines 92, which are connected to the inputs of On/Off gating circuit 94. If, on the other hand, knee lever 84 is actuated, the closure of switch 86 places a logic 0 ground potential DC signal on line 88, which is gated to the input 82 of data selector 80 by control logic 90 thereby causing the connection of output lines 78 from the minor ROM 74 to the inputs 92 of On/Off gating 94.

Control logic 90 is responsive to two additional control signals on lines 95 and 96. When the automatic chord feature is activated by closing switch 98, a ground potential DC control signal on line 96 is gated by control logic 90 to place a disabling signal on the On/Off input 100 of gating circuit 94 thereby disabling gating circuit 94 from passing the five bit binary major or minor chord word on inputs 92 to the inputs 102 of combining logic circuit 104. At the same time, the presence of the ground potential automatic chord signal on line 96 is gated by control logic circuit 90 to line 106, which serves to enable On/Off gating circuit 108 to pass the five bit binary chord word from accompaniment manual encoder 34. For ease in notation, the five bit chord word generated by ROM 70, will be identified as the MPQRN word and the five bit binary chord word from accompaniment manual encoder 34 as the M′P′Q′R′N′ word.

Conversely, if automatic chord switch 98 is open, opposite logic levels will be present on lines 100 and 106 so that gating circuit 94 will be enabled and gating circuit 108 will be disabled. In order to activate the pedalboard encoded note pattern generation system, switch 110 is closed thereby placing a ground potential DC control signal on line 95, which is routed to the input 100 of On/Off gating circuit 94 by control logic 90. Thus, in order to activate the pedalboard encoded system, switch 100 must be closed and switch 98 must be open. If either of these conditions is absent, then gating circuit 94 will be disabled.

Combining logic circuit 104 functions as an OR gate by permitting either the five bit MPQRN word on inputs 102 or the M′P′Q′R′N′ word on inputs 112 to pass to outputs 114. The five bit binary word on inputs 114 is connected to the chord word inputs 116 of note pattern generator 118, which is driven by rhythm unit 120. The output control signals from note pattern generator 118 are connected to solo keyers 16 over lines 122.

Referring now to the aforementioned U.S. Pat. No. 4,120,225, a suitable note pattern generator is disclosed. Referring to that system, the inputs 116 shown in FIG. 1 of the present application would be connected to the inputs of latch 20, although a five bit latch would be used rather than the four bit latch illustrated therein. The system described in U.S. Pat. No. 4,120,225 would utilize this chord word data to produce the appropriate pattern of notes in the manner described therein, although in a multiplexed environment. The output signals would appear on the outputs of encoders 212 illustrated in FIG. 12 of U.S. Pat. No. 4,120,225.

In the aforementioned U.S. Pat. No. 4,220,068, the five bit chord word on inputs 116 would be connected to the inputs of 1 of 32 decoder 116 in Figure 3A of said application. Again, although the note pattern data is generated in a multiplexed environment, the end result would still be the same, which is the generation of note pattern data at the inputs of keyers 252 and 264 in the application.

Because the note pattern generators disclosed in U.S. Pat. Nos. 4,120,225 and 4,220,068 are known, they have not been described in detail in the present application, but merely incorporated by reference. The two note pattern generators described in the aforementioned patent and application are merely exemplary, however, and are not intended to limit the scope of the present application. Other prior art note pattern generators presently incorporated in existing electronic organs could also have the pedalboard encoding system of the present invention incorporated therein.

Figure 2A:
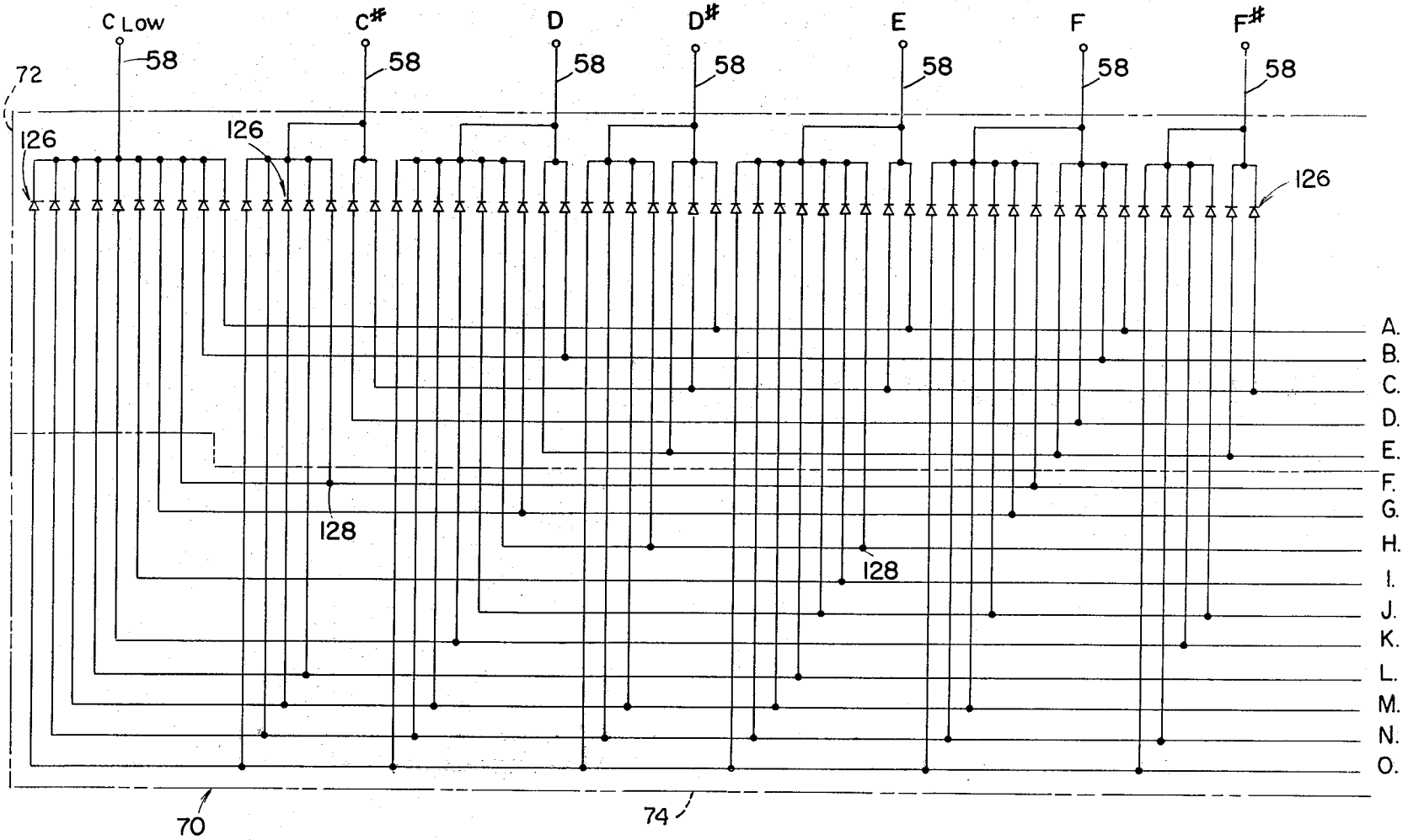
Figure 2B:
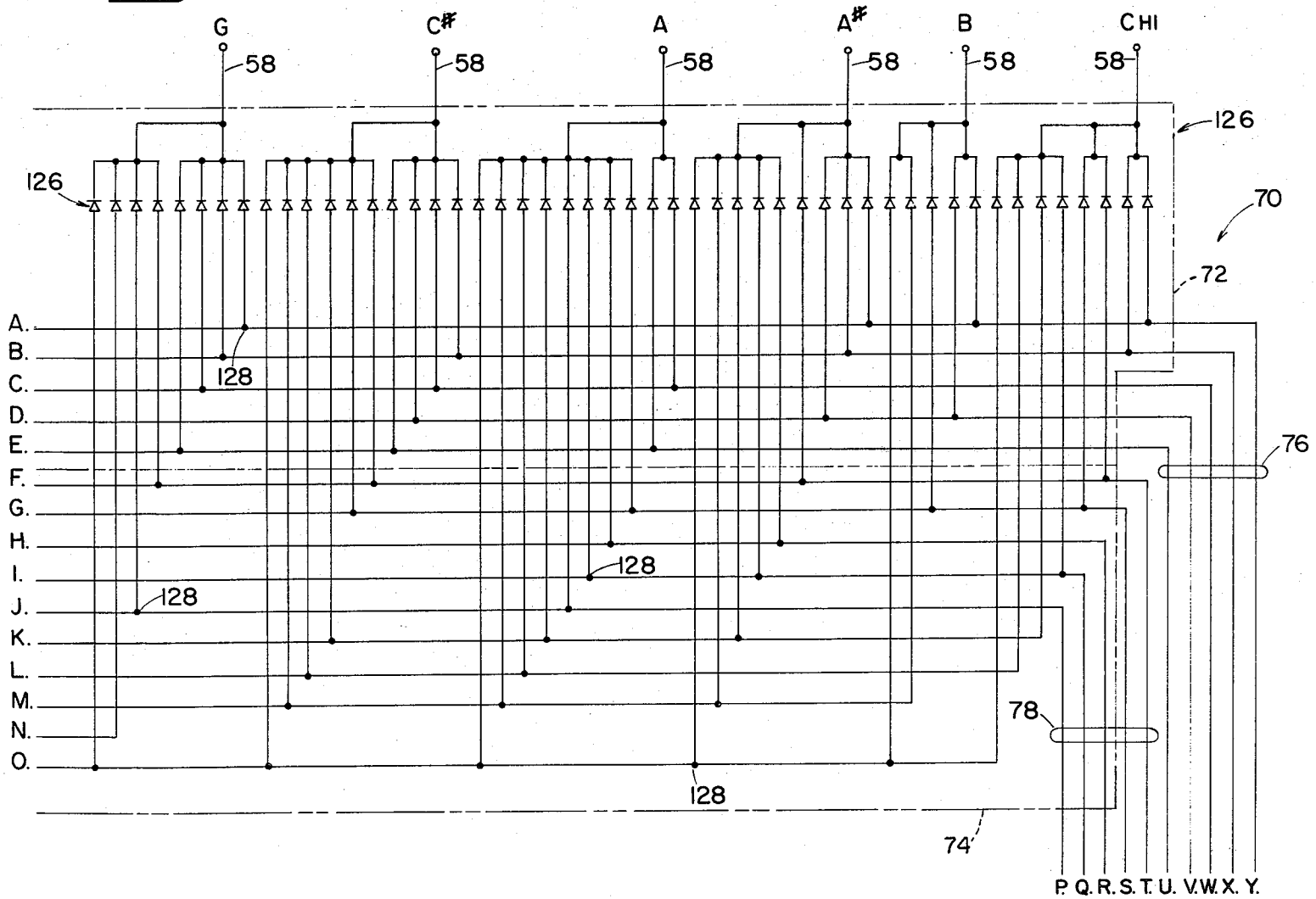

Referring now to FIGS. 2A and 2B, the encoding circuitry comprising ROM 70 is illustrated. It will be seen that thirteen input lines 58 spanning thirteen pedals running from low C to the C an octave higher on the pedalboard 50 are connected to diode banks 126, the anodes of which are connected to various innerconnection points 128. Depending on which of the horizontal lines have connections with the vertical lines connected to the anodes of the diodes 126 for each of the input lines 58, a particular pair of five bit binary words will be formed. Since the ROM 70 is ground seeking, ground potential on the inputs by virtue of closure of the pedalboard switches 54 will create a corresponding ground potential on the connecting output line 76 or 78. For example, assuming that the E natural pedal 52 is depressed thereby closing the corresponding keyswitch 54, ground potential will be present on input 58 identified with the letter "E". This will place a corresponding ground potential (logic 0) on the horizontal lines denoted A, C, H, I, and J. This corresponds to a major key binary word on output line group 76 of 01011, and a minor key chord word on the other group of output lines 78 of 11000. These two binary words correspond to the E major and E minor triads, respectively. By examining the connection points of ROM 70, the binary chord words for the other pedals 52 of pedalboard 50 can be determined. Although a particular encoding scheme has been illustrated, the present invention is not so limited, and is intended to cover other encoding arrangements which would be appropriate.

Figure 2C:
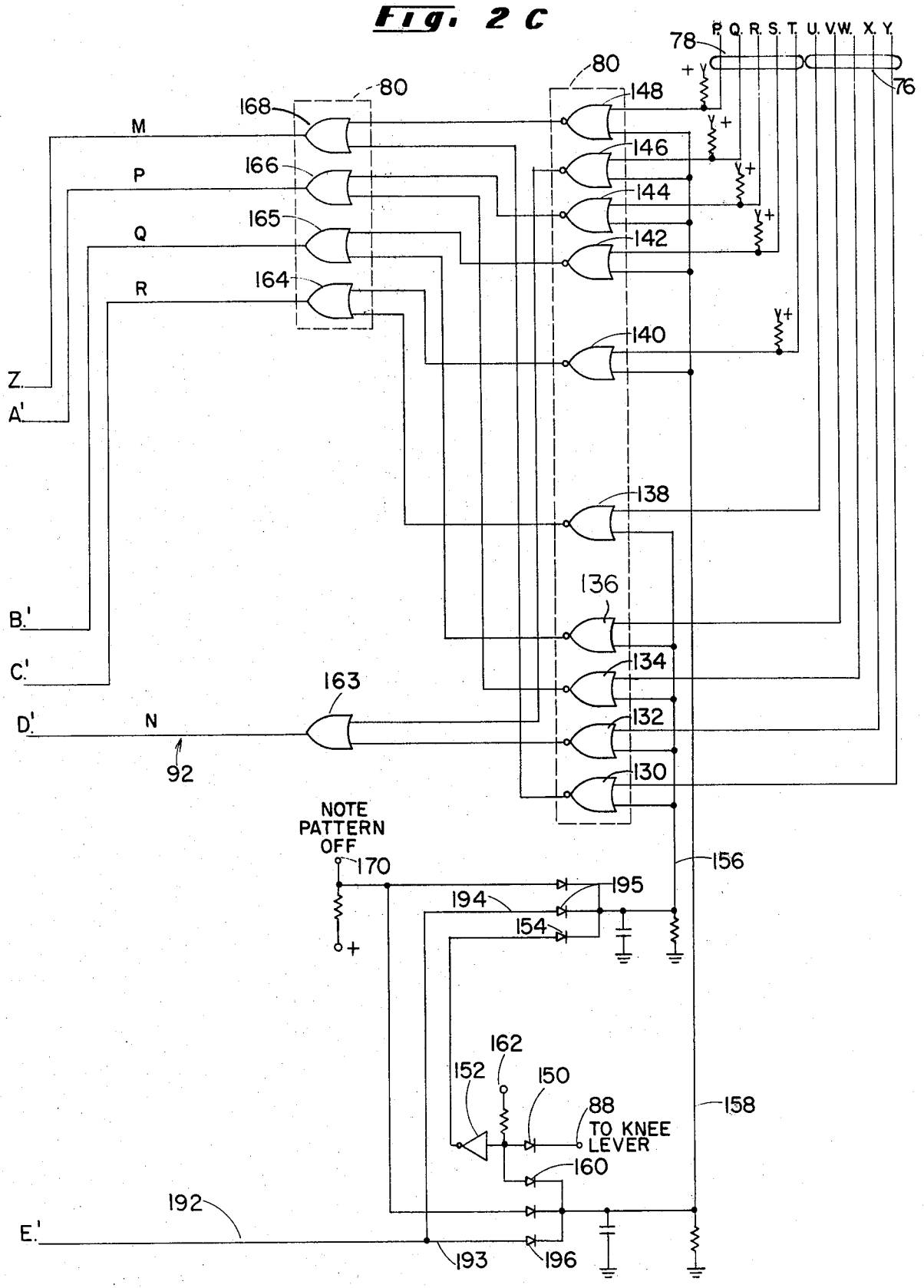
Figure 2D:
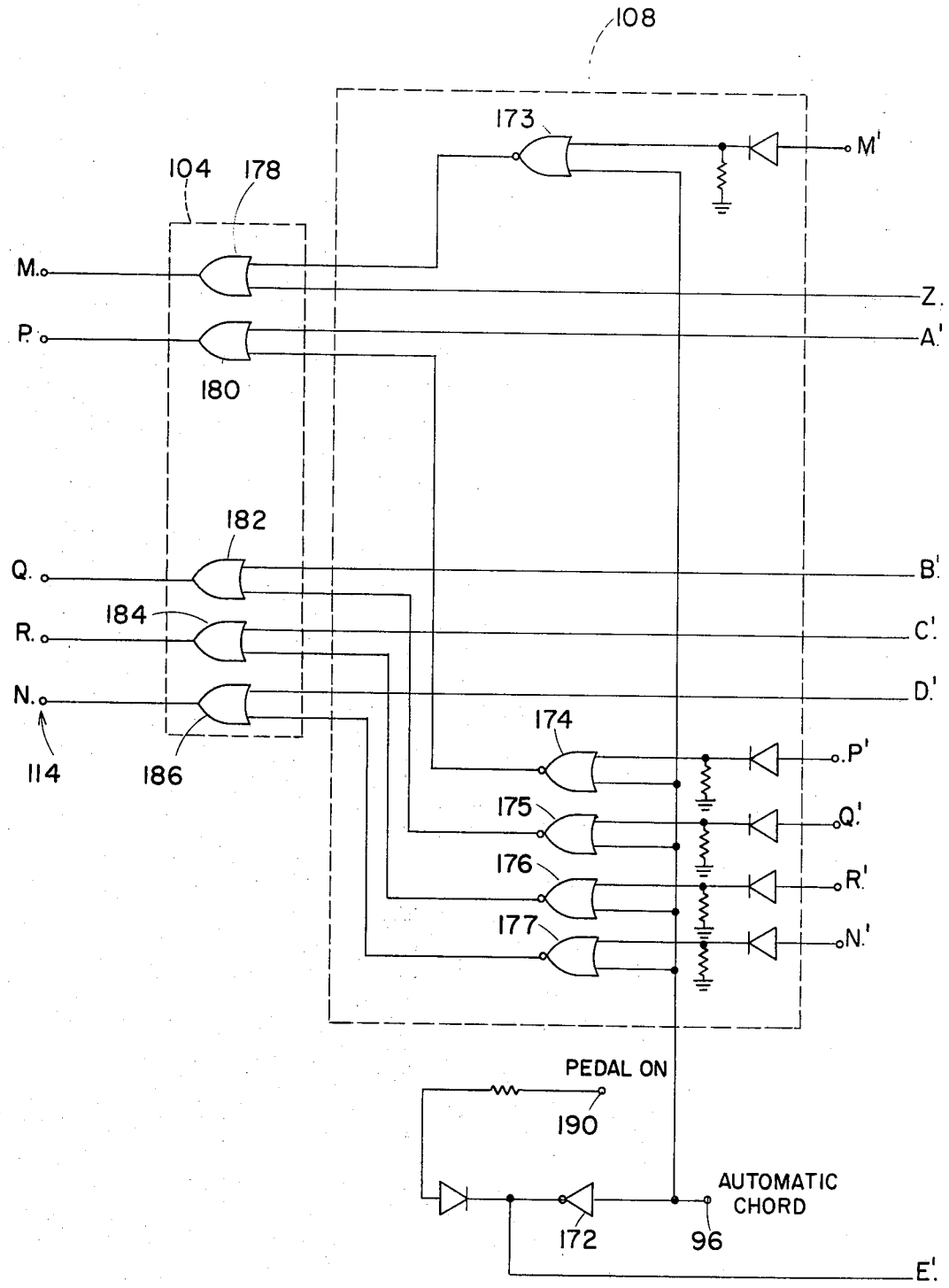

Referring now to FIG. 2C, the five bit binary chord words on output lines 76 are connected to one of the inputs of NOR gates 130, 132, 134, 136 and 138, and the output lines 78 of ROM 70 are connected to one of the inputs of NOR gates 140, 142, 144, 146 and 148. NOR gates 130–148 make up the data selector 80 illustrated in FIG. 1. Input line 88 from the knee lever switch 86 is connected through diode 150, inverter 152 and diode 154 to bus 156, which is connected to the other inputs of NOR gates 130, 132, 134, 136 and 138, corresponding to the major chord word output 76. Knee lever input 88 is connected through diodes 150 and 160 to bus 158, which is connected to the other inputs of NOR gates 140, 142, 144, 146 and 148, corresponding to the minor chord outputs 78. With knee lever switch 86 open, the positive voltage (logic 1) on terminal 162 will place bus 158 at a logic 1 through diode 160 thereby disabling NOR gates 140–148. The logic 1 voltage on terminal 162 will be inverted by inverter 152, however, so that bus 156 will be at ground potential and NOR gates 130–138 will be enabled. This results in passing the major chord binary word through NOR gates 130–138 to OR gates 163, 164, 165, 166 and 168.

When knee lever switch 86 is closed, input 88 is grounded and inverter 152 places a logic 1 on bus 156 which disables NOR gates 130–138, and the corresponding logic 0 level on bus 158 enables NOR gates 140–148. Thus, the MPQRN word on lines 92 will correspond to either the major key chord or the minor key chord having as its root tone the depressed pedal 52 of pedalboard 50. If the note pattern switch 110 is open, the logic 1 voltage level on terminal 170 will place a logic 1 level both on bus 156 and bus 158 thereby disabling all of NOR gates 130–148 so that no MPQRN word will be present on lines 92. When automatic chord switch 98 (FIG. 1) is closed, logic 0 potential will be present on input line 96 (FIG. 2D), and this will be inverted by inverter 172, thereby disabling NOR gates 130–148 by the logic 1 potential on buses 156 and 158. The logic 0 potential on terminal 96 will enable NOR gates 173, 174, 175, 176 and 177 so that the M'P'Q'R'N' chord word from accompaniment manual encoder 34 (FIG. 1) will be passed to the inputs of OR gates 178, 180, 182, 184 and 186. If, on the other hand, the automatic chord switch 98 is open, NOR gates 173–177 will be disabled and NOR gates 130–148 will be enabled, as described earlier.

If the pedalboard is to be used normally without the encoding feature described above, a logic 1 is placed on terminal 190 (FIG. 2D), which serves to disable NOR gates 130–148 by placing a logic 1 on buses 156 and 158 via lines 192, 193 and 194 and diodes 195 and 196.

Either the MPQRN word or the M'P'Q'R'N' word is gated through combining logic 104 comprising OR gates 178–186 to lines 114, which are connected to the inputs 116 of the appropriate note pattern generator 118.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electronic organ comprising:

a keyboard including a plurality of keys corresponding respectively to tones of the musical scale and adapted to be played by the player's hands, manual keyer means controlled by said keyboard for producing tones corresponding to the depressed keys of said keyboard within a first frequency range, a pedalboard including a plurality of pedals corresponding respectively to bass tones of the musical scale and adapted to be played by the player's feet, pedal keyer means controlled by said pedalboard capable of producing bass tones corresponding to said pedals within a second frequency range lower than the first frequency range, said pedal keyer means normally producing at least one continuous bass tone corresponding to a depressed pedal, selectively operable note pattern generator means connected between said pedalboard and said manual keyer means and responsive to the depression of any one of said pedals for causing said manual keyer means to generate a note pattern comprising a sequence of diverse tones in a rhythmic rate pattern wherein the diverse tones are notes of a chord having as its root the same pitch as the bass tone corresponding to said any one pedal that is depressed, said pedal keyer means being capable of sounding said bass tone corresponding to said any one pedal that is depressed simultaneously with the sounding of the note pattern by the manual keyer means, said note pattern generator means causing said note pattern to be sounded independently of the actuation of any keys of said keyboard.

2. An electronic organ comprising:

a keyboard including a plurality of keys corresponding to tones of the musical scale and adapted to be played by the player's hands, a pedalboard including a plurality of pedals corresponding respectively to bass tones of the musical scale and adapted to be played by the player's feet, tone producing means for generating selected tones and having control inputs, keyboard controlled means connected between said keyboard and a plurality of said tone producing means control inputs for causing said tone producing means to generate tones corresponding to depressed keys of the keyboard and within a first frequency range, pedalboard controlled means connected between said pedalboard and a plurality of said tone producing means control inputs for normally causing said tone producing means to generate a bass root tone corresponding to a depressed pedal of said pedalboard and within a second frequency range which is generally lower than that of the first frequency range, selectively operable note pattern generator means connected between said pedalboard and said tone producing means and responsive to the depression of any one of said pedals for causing said tone producing means to generate a frequency of diverse tones in a rhythmic rate pattern wherein the diverse tones are notes of a chord having as its root the same pitch as the bass tone to which said any one pedal that is depressed corresponds, said diverse tones being in said first frequency range and generally higher in frequency than the bass root tones corresponding to the pedals of said pedalboard, and means selectively causing the bass root tone corresponding to the depressed pedal to sound continuously and simultaneously with the sounding of said rhythmic rate pattern of tones, said note pattern generator means causing the sounding of the rhythmic rate pattern of the diverse tones independently of the actuation of the keys of said keyboard.

3. The electronic organ of claim 1 including player operated means for selectively causing said chord to be the minor chord having as its root the same pitch as the bass tone corresponding to said any one pedal that is depressed.

4. The electronic organ of claim 1 wherein said pedalboard includes keyswitches actuated by respective said pedals, and said note pattern generator means includes:

an encoder means connected to said keyswitches for encoding said keyswitches as a binary word corresponding to said chord, and means for decoding said binary word and producing said sequence of diverse tones.

5. The electronic organ of claim 4 wherein said note pattern generator means includes a memory in which a plurality of said rhythmic patterns are stored, and player operated means for selecting one of said patterns for sounding of the sequence of diverse notes.

6. The electronic organ of claim 1 wherein said pedalboard includes keyswitches actuated by respective said pedals, and a said note pattern generator means includes: an encoder means connected to said keyswitches for encoding the keyswitch corresponding to said any one pedal that is depressed as two multiple bit binary words wherein one of said words corresponds to the major version of said chord and the other word corresponds to the minor version of said chord, player operated means for selecting one of said words, and means connected to said means for selecting for decoding said selected word and producing said sequence of diverse tones.

7. The electronic organ of claim 6 wherein said note pattern generator means includes a rhythm generator means for generating rhythmic beats for the sequence of tones, a memory for storing a plurality of said rhythmic patterns, and player operated means for selecting one of said stored patterns for sounding the sequence of the diverse tones.

* * * * *